United States Patent [19]

Teik

[11] Patent Number: 5,014,582

[45] Date of Patent: May 14, 1991

[54] CARTON BLANK DECELERATION UNIT

[75] Inventor: Goh B. Teik, Petaling Jaya, Malaysia

[73] Assignee: Komori-Chambon SA, Orleans, France

[21] Appl. No.: 301,355

[22] Filed: Jan. 24, 1989

[51] Int. Cl.[5] ..... B26D 7/32; B31B 1/16; B65H 29/66

[52] U.S. Cl. ..... 83/24; 83/88; 83/110; 83/152; 493/362; 493/369

[58] Field of Search ..... 83/88, 110, 152, 405, 83/422, 103, 24, 27; 493/355, 362, 369; 271/202, 270, 276, 69; 225/99, 100, 150

[56] References Cited

U.S. PATENT DOCUMENTS

| | | | |
|---|---|---|---|
| 2,481,934 | 9/1949 | Langston | 271/183 X |
| 3,178,174 | 4/1965 | Schneider | 271/46 |
| 3,336,028 | 8/1967 | Schonmeier | 271/74 |
| 3,595,564 | 7/1971 | De Young | 83/88 X |
| 3,672,667 | 6/1972 | Pahlitzsch | 271/74 |
| 3,791,269 | 2/1974 | Sawada | 93/93 |
| 3,802,699 | 4/1974 | Wiig et al. | 271/202 X |
| 3,861,259 | 1/1975 | Hitch | 83/152 X |
| 3,951,022 | 4/1976 | Hurtes | 83/152 |
| 4,103,595 | 8/1978 | Corse | 493/362 |
| 4,184,392 | 1/1980 | Wood | 83/110 X |
| 4,289,052 | 9/1981 | Woolston et al. | 83/110 X |
| 4,433,599 | 2/1984 | Mundus et al. | 83/152 X |
| 4,785,696 | 11/1988 | Martiny | 83/152 |

*Primary Examiner*—Douglas D. Watts
*Assistant Examiner*—Kenneth E. Peterson
*Attorney, Agent, or Firm*—Burns, Doane, Swecker & Mathis

[57] ABSTRACT

A machine is described for handling die-cut carton blanks as they emerge from the die-cutter. The die cut web is separated into sheets of blanks and projected sequentially onto a conveyor. The conveyor is operated at a speed which is less than that at which the sheets are projected onto the conveyor so that the distance between the sequential die cut is closed up, the sheets being maintained in contact with the conveyor by air pressure.

13 Claims, 2 Drawing Sheets

CARTON BLANK DECELERATION UNIT

Figure 1:
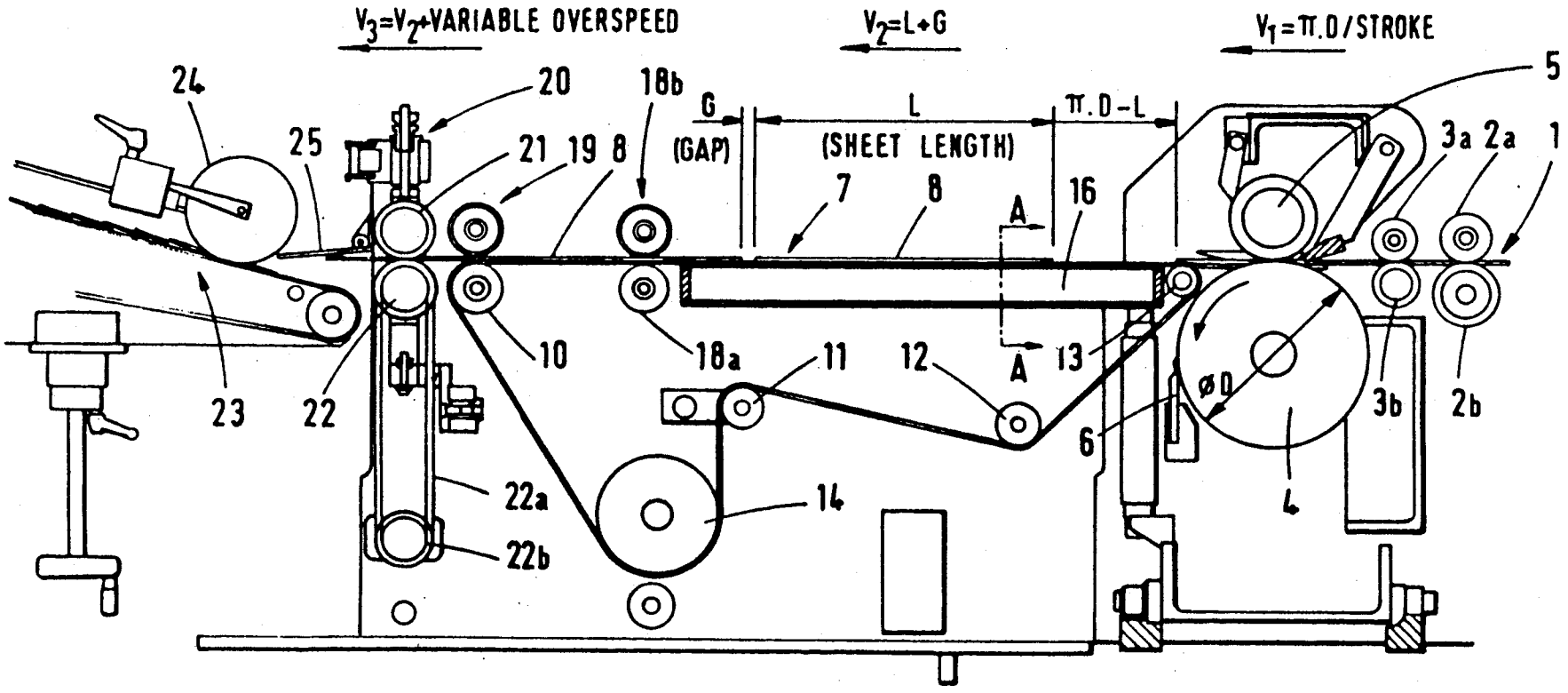

This invention relates to carton blank die-cutting machines of the kind in which a web of cardboard is fed to a die-cutter, separated into sheets of carton blanks and then conveyed to a separator unit from which the sheets of blanks are ejected onto a receiving conveyor.

In reciprocating die-cutting machines of this kind, a pair of kicker rollers are located downstream from the die-cutter and arranged to receive the web as it emerges from the die-cutting station. The operation of the kicker rollers is timed so that as the web slows towards the end of its feed cycle into the cutter station or has actually stopped, the kicker rollers operate to break the nicks or tabs which join the sheets of groups of blanks together and propel the individual sheets sequentially onto a receiving conveyor and then into a waste-stripping unit. At the waste-stripping unit, the separated sheets are drawn through the unit at a speed which is determined by the diameter of the stripper drum. A stripper drum is selected whose circumference is such that a die-cut sheet which is transported through the unit is not caught up by the succeeding sheet. As a consequence, a gap is opened up between successive die-cut sheets which is related to the circumference of the drum less the length of a sheet. After stripping away the waste, the die-cut sheets are transported to a further conveyor via separator rollers which cause the sheets to be separated into individual blanks. This necessitates a further increase in speed over and above that produced by the waste stripper, thus further increasing the separation between individual blanks.

With the ever-increasing demands for higher and higher production speeds and the necessity of increasing the relative speed of the die-cut sheets at the waste-stripping unit with respect to the web speed, it becomes more and more difficult to control the operation of high speed carton blank die-cutting machines without damage to the blanks or misfeeds causing production hold-ups.

It has now been discovered that these problems can be largely overcome by introducing between the waste-stripping unit and the rollers which cause the separation of the carton blanks, a sheet deceleration unit which slows down the speed of the die-cut sheets sufficiently to close up the gap or substantially close up the gap between individual sheets. In one form of the invention, this is achieved by use of air pressure to maintain contact between the sheets and a conveyor running at a slower speed than the speed at which the sheets are propelled from the waste-stripping unit.

According to one aspect of the present invention, there is provided a web-fed, carton blank die-cutting machine assembly in which a web of cardboard is fed from a die-cutting machine, separated into die-cut sheets of blanks and then projected sequentially onto a conveyor, characterised in that the conveyor is operated at a speed which is less than that at which the blanks are projected onto the conveyor, so that the distance between die-cut sheets is substantially closed up, the sheets being maintained in contact with the conveyor by air pressure.

The die-cutting machine may be a reciprocating die-cutter in which the die-cut sheets are propelled from the die-cutting station into a waste-stripping unit as described above. However, the present invention can also be applied to fixed diameter rotary die-cutting machines. In one form of the invention, the conveyor onto which the die-cut sheets are received and decelerated, comprises a belt or series of belts guided to run over a plate, contact being developed between the sheets and the belts by differential air pressure. The differential air pressure is preferably provided by forming apertures in the plate on which the belts run, and applying suction from beneath. It may be sufficient to apply suction only in one zone of the plate over which the belts run, e.g. close to the point where they are propelled from the waste-stripping unit or from the fixed diameter rotary cutting drum in zones which correspond to the lateral edges of the sheets.

Figure 2:
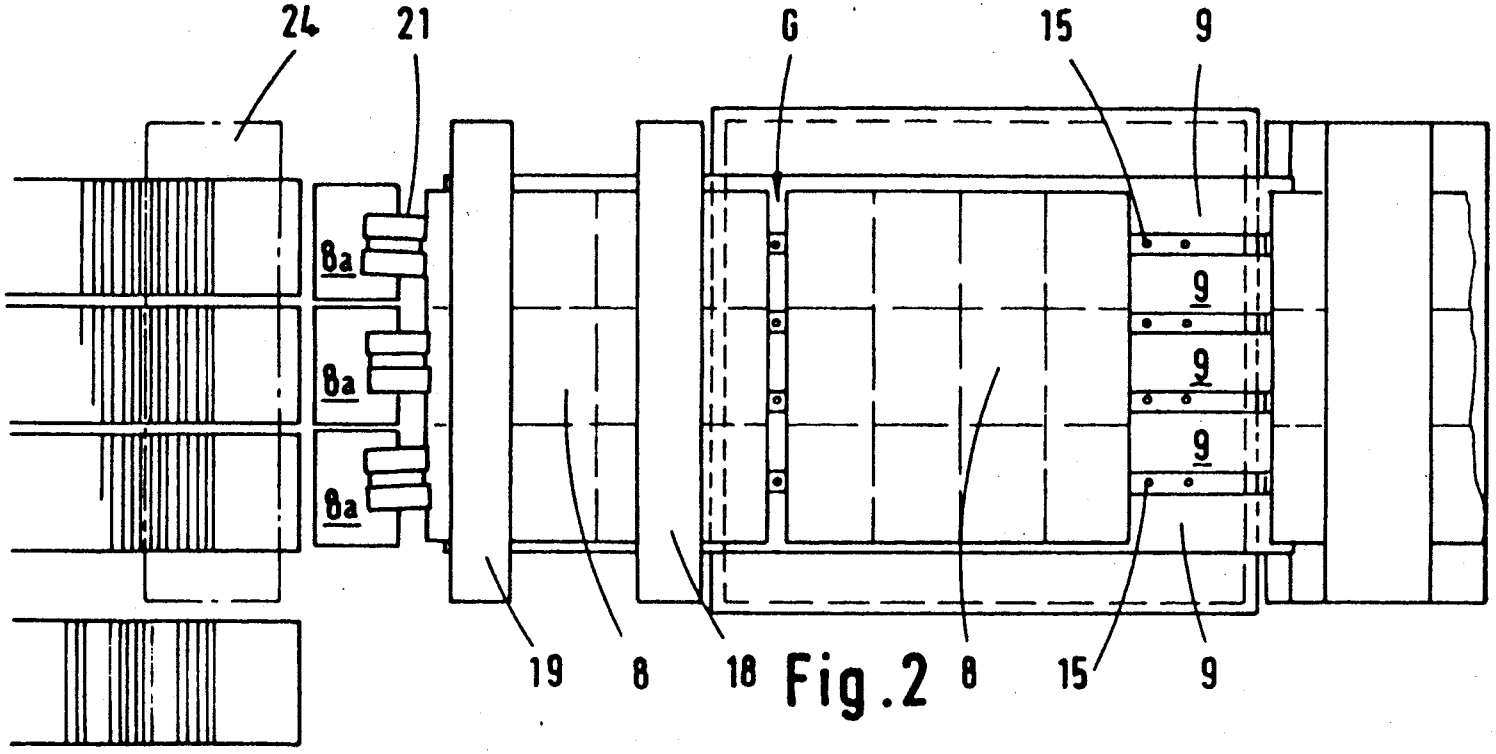
Figure 3:
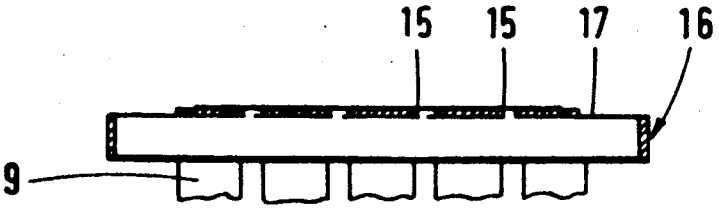

Further features and advantages of the present invention will become apparent from the following description and accompanying drawings of one embodiment of a machine in accordance with the invention, in which:

FIG. 1 is a side elevation of a portion of the die-cutting machine showing the deceleration unit and the collecting conveyor, FIG. 2 is a plan view of the apparatus shown in FIG. 1, and FIG. 3 is a sectional elevation taken along the line A—A in FIG. 1.

Referring to the drawings, a web 1 of cardboard is die-cut in a reciprocating die-cutting unit 100 of conventional form, separated into die-cut sheets comprising a plurality of connected blanks and transported via guide rollers *2a/2b* and *3a/3b* into a waste-stripping unit. The waste-stripping unit comprises a stripping drum 4, which is fitted with pins (not shown) arranged at spaced intervals to remove areas of waste from the sheets and a corresponding top roller 5. The position of the pins on drum 4 can be adjusted depending on the pattern of the die-cut blanks. Portions of waste adhering to the pins on roller 4 are carried downwardly to a point where they are lifted off the drum by a comb 6. Alternatively, they can be pushed off the pins by ejectors. The waste-stripping unit projects the separated sheets of blanks forwardly onto a receiving conveyor generally indicated at 7. Because the pin carrying cylinder 4, which determines the speed at which the cut sheets are propelled onto the conveyor 7 is of fixed diameter, the speed $V_1$ at which the cut sheets are projecting forwardly onto the conveyor 7 is a function of $\pi D$, (where D = the diameter of cylinder 4), and the stroke of the die-cutting unit. The diameter D of the cylinder 4 is selected so that its speed is sufficient to accommodate the maximum draw length of each sheet from the die-cutting unit plus the distance required to ensure that a die-cut sheet which is transported to the waste-stripping unit from the die-cutting machine is not caught up by a following sheet still joined to the main web. As a consequence, a gap is opened up between consecutive sheets 8, which is equal to the difference between the circumference of the cylinder 4 and the sheet length. This gap $\pi$.D-L is shown diagrammatically on FIG. 1.

If the speed of the conveyor 7 were the same as that of the waste-stripping unit, this gap would remain and would be further widened by the downstream separator rollers as will be described hereinafter.

Deceleration of the sheet lengths 8 takes place on the conveyor 7. Conveyor 7 comprises a plurality of belts 9 which are guided over a series of rollers 10, 11, 12 and 13, and driven by a variable speed drive roller 14. The speed of belts 9 forming conveyor 7 can be adjusted but are normally run at a speed which is about 5% higher than the web speed through the die-cutting machine and about 10% less than the speed at which the sheets are ejected from the waste-stripping unit. The sheets fed to the conveyor 7 are maintained in contact with the belts 9 by means of suction apertures 15, located between belts 9. Apertures 15 can be of any shape and may be located between the belts or, for example, in the case of slots may extend beneath the belts, which may be of porous or open mesh construction. Suction is applied to the apertures 15 to an extent necessary to bring sheets 8 rapidly to the speed of the belts 9 and thereby close up the distance or interval $\pi$D-L to a small gap G, at which the consecutive sheets are just abutting or separated by a small gap such that the interval $\pi$D-L is substantially reduced. Suction is maintained through apertures 15 by forming the bed of the conveyor as a suction box 16, the top plate 17 of which provides the apertured base over which the belts 9 are guided. A reduced pressure of a few inches of water gauge below atmospheric pressure is maintained within suction box 16 by connecting the box with the inlet side of a small centrifugal blower (not shown). As can be seen from FIGS. 1 and 2, the suction equalizes the speed of the sheets 8 with the speed of the conveyor 7 and positions the sheets on the conveyor such that the intervals $\pi$D-L between the sheets 8 are substantially reduced without overlap of the sheets 8.

From the conveyor 7, the sheets 8 which consist of a series of individual carton blanks joined together by nicks or tabs, are transported to a separator assembly where they are separated into individual carton blanks 8*a*. The example illustrated in FIG. 2 shows three carton blanks across and four along each sheet.

The sheets are fed by transfer rollers 18 and/or 19 into a separator assembly 20 comprising groups of separator rollers 21 and 22. Transfer roller 19 is fixed in position and is used particularly for short cartons by ensuring that all the rows of carton blanks are held at the speed of conveyor 7, while the preceding carton blanks are pulled away by the separator rollers 21 and 22. Transfer rollers 18 and 18*a* are adjustable in position lengthwise of the conveyor 7 to enable longer carton blanks to be controlled in a similiar manner, in which case roller 19 can be raised to an inoperative position or even removed from the machine. Separator rollers 21 and 22 accelerate the sheets to a speed $V_3$ which is about 10% over the speed $V_2$ of the sheets on the conveyor 7. Rollers 22 are driven by belts 22*a* from a variable speed drive 22*b* mounted beneath the conveyor surface. The increased speed of the separator rollers acting on the sheets causes the individual carton blanks to be severed from each other along the lateral score lines. Also, because the separator rollers are arranged and grouped in such a way that the outer rollers are progressively angled slightly outwardly, an outward severing force component is applied to the carton blanks, causing the blanks to be separated simultaneously along longitudinal score lines. The individual blanks are ejected from separator rollers onto a collecting conveyor 23, which carries the individual blanks away from the machine to a packing station. Conveyor 23 includes a check roller 24 and a deflector plate 25 and is operated at a slower speed than the separator rollers 21 and 22. Thus, the individual carton blanks are collected on the conveyor 23 in shingled or overlapping form from which they can be bundled and packed.

The left-hand side of FIG. 2 shows the shingled configuration in which the blanks are received on the conveyor 23 and it will be seen that the blanks are substantially uniformly overlapped, which is the ideal arrangement for receiving blanks from such a machine. In comparison, there is shown below in FIG. 2, the configuration achieved without a decelerating conveyor between the waste-stripping unit and the separator rollers. As can be seen, there is large spacing between batches of blanks received from each die-cut sheet. This non-uniform feeding of individual carton blanks or batches of blanks to the collecting conveyor makes it difficult to operate the die-cutting machine 100 at its maximum speed, and causes problems in collecting the individual cut blanks without misfeeding or damage to the edges of flaps.

The machine assembly described above may be used with any conventional die-cutting machine. An example of a die-cutting machine for carton blanks is described in U.S. Pat. No. 4,137,829 (issued Feb. 6, 1979 to Albert J. Sarka), the disclosure of which is incorporated herein by reference.

In some cases, it may be advantageous not to slow the sheets down as they are ejected from the waste-stripping unit. This is the case, for example, where the web is cut into sheets with individual waste bars between consecutive sheets which are removed by pins on drum 4. In this case, the distance between the sheets cannot be completely closed up and in such cases it is generally necessary to speed up the conveyor so that the sheets are fed at or close to the ejection speed of the waste stripping unit into the separator rollers. Although in such cases there may be no speed differential, the suction/belt conveyor provides an improved method of transporting carton blank sheets at high speed compared with the traditional method which involves propelling the sheets by pairs of rollers into the separate assembly.

I claim:

1. A machine assembly for producing and handling die-cut sheets of carton blanks, comprising:

a die-cutting machine for cutting a web into separate sheets of carton blanks;

a waste-stripping unit for receiving the sheets from said die-cutting machine and for projecting the sheets at a predetermined speed and at spaced intervals sequentially onto a conveyor;

means for operating said conveyor at a speed which is less than the predetermined speed at which the sheets are projected onto said conveyor and which is so related to the predetermined speed at which the sheets are projected onto said conveyor that the spaced intervals between the sheets are substantially reduced; and suction means for bringing the sheets into contact with said conveyor to equalize the speed of the sheets with the speed of said conveyor and for positioning the sheets on said conveyor such that the spaced intervals between the sheets are substantially reduced without overlap of the sheets, said suction means constituting the sole means for equalizing the speed of the sheets with the speed of said conveyor; and separating means for separating the spaced sheets of carton blanks into individual carton blanks.

2. A machine assembly for producing and handling die-cut sheets of carton blanks, comprising:

a die-cutting machine for cutting a web into separate sheets of carbon blanks;

a waste-stripping unit for receiving the sheets of carton blanks from said die-cutting machine and for projecting the sheets at a predetermined speed and at spaced intervals sequentially onto a conveyor;

means for operating said conveyor at a speed which is less than the predetermined speed at which the sheets of carton blanks are projected onto said conveyor and which is so related to the predetermined speed at which the sheets are projected onto said conveyor that the spaced intervals between the sheets are substantially reduced;

suction means for bringing the sheets of carton blanks into contact with said conveyor to equalize the speed of the sheets with the speed of said conveyor and for positioning the sheets on said conveyor such that the spaced intervals between the sheets are substantially reduced without overlap of the sheets; and separating means for separating the spaced sheets of carton blanks into individual carton blanks.

3. A machine assembly according to claim 2, wherein the conveyor is a belt conveyor including one or more belts, and means for projecting said sheets onto the conveyor from said waste-stripping unit.

4. A machine assembly according to claim 3, further comprising a base plate over which the belts are guided and wherein said suction means comprises apertures formed in the base plate and means for applying suction to the apertures.

5. A machine assembly according to claim 4, wherein said means for applying suction to the apertures includes a suction box, the upper surface of which comprises the base plate.

6. A machine assembly according to claim 5 in which the apertures are located between the belts.

7. A machine assembly according to claim 4 in which the apertures are located between the belts.

8. A machine assembly according to claim 2, further comprising a base plate over which the conveyor is guided and wherein said suction means comprises apertures formed in the base plate, and means for applying suction to the apertures.

9. A machine assembly according to claim 8, wherein said means for applying suction to the apertures includes a suction box, the upper surface of which includes the base plate.

10. A machine assembly according to claim 8, wherein the conveyor is a belt conveyor including one or more belts, and said apertures are located between the belts.

11. A machine assembly according to claim 9, wherein the conveyor is a belt conveyor including one or more belts, and said apertures are located between the belts.

12. A method of producing carton blanks, comprising the steps of:

feeding a web to a die-cutting machine;

separating the die-cut web into sheets of blanks;

removing waste portions from the sheets of blanks in a waste-stripping unit;

projecting the sheets of blanks sequentially at a predetermined speed and at spaced intervals onto a conveyor;

moving the conveyor in the same direction as the projected sheets of blanks but at a speed slower than the predetermined speed;

applying suction to the sheets of blanks to bring the sheets to the same speed as the conveyor and to substantially reduce the spaced intervals between the sheets without overlap of the sheets; and feeding the spaced sheets of blanks to a separating unit for separating the sheets into individual blanks.

13. A method according to claim 12 in which the conveyor is operated at a speed which is about 10% less than that at which the sheets are projected from the waste-stripping unit.

* * * * *